US005348405A

United States Patent [19]

Lupkas

[11] Patent Number: 5,348,405

[45] Date of Patent: Sep. 20, 1994

[54] COMPUTER KEYBOARD KEY DEPRESSION INHIBITOR DEVICE

[75] Inventor: Raymond R. Lupkas, Trumbull, Conn.

[73] Assignee: Jacqueline M. Lupkas, Trumbull, Conn.

[21] Appl. No.: 105,143

[22] Filed: Aug. 12, 1993

[51] Int. Cl.[5] ..... B41J 5/26

[52] U.S. Cl. ..... 400/472; 400/490

[58] Field of Search ..... 400/472, 490, 493.1, 400/495, 676, 677, 714, 715–717, 663, 672.1, 672.2, 496, 692, 693, 679, 686, 687; 235/145 R, 146

[56] References Cited

U.S. PATENT DOCUMENTS

| | | | |
|---|---|---|---|
| 2,492,262 | 12/1949 | Boyden et al. | 45/68.1 |
| 3,527,914 | 3/1969 | Spacek | 200/43.19 |
| 4,540,858 | 9/1985 | Knoop | 200/5 R |
| 4,755,072 | 7/1988 | Hoornweg | 400/490 |
| 4,948,281 | 8/1990 | Werner | 400/472 |
| 5,096,317 | 3/1992 | Phillippe | 235/145 R |
| 5,183,346 | 2/1993 | Tesar | 400/490 |
| 5,193,924 | 3/1993 | Larson | 400/472 |

*Primary Examiner*—Edgar S. Burr
*Assistant Examiner*—Anthony H. Nguyen
*Attorney, Agent, or Firm*—Martin D. Wittstein

[57] ABSTRACT

A key depression inhibitor device for a computer keyboard is disclosed which is intended to prevent accidental or inadvertent manual depression of a certain key or combination of keys on a computer keyboard. The device has top, side and end walls which form a generally hollow cover adapted to fit over a single key or certain combinations of key in the "F" key section, page control key section and cursor control key section of a computer keyboard. The device is constructed to fit snugly over the key or combination of keys which it is intended to cover and to be readily removable therefrom, so that it can be installed and removed at will as needed.

8 Claims, 6 Drawing Sheets

COMPUTER KEYBOARD KEY DEPRESSION INHIBITOR DEVICE

BACKGROUND OF THE INVENTION

This invention relates generally to the field of computer keyboards, and more particularly to a key depression inhibitor device which can be easily installed on a computer keyboard to temporarily cover a selected key or combination of keys to prevent accidental or inadvertent depression of those keys during normal operation of the keyboard.

Present day computer keyboards have evolved into a high level of functional sophistication that permits certain keys to be multifunctional and to perform different functions depending upon a variety of utility situations in the computer with which the keyboard is associated. As is well know, in addition to the usual array of alphanumeric keys formally associated with typewriters which are necessary to perform basic text input functions, the vast majority of computer keyboards now in use include a plurality of special purpose keys which control various operational functions of the computer. For example, on a typical keyboard, there are 15 so-called "F" or "Function" keys, usually labeled F-1 to F-15, which control various operational functions of the computer. In addition, between the alpha and numeric sections of the keyboard, there are and additional six keys usually labeled Help, Home, Page Up, Delete, End and Page Down, and beneath these are four keys, usually arranged in an inverted "T" configuration, which control the left, right, up and down movement of the computer cursor on the screen. There are, of course, other configurations found on keyboards for special purpose applications, but the foregoing is fairly representative of the majority of keyboards utilized with most general purpose computers.

It is customary practice with keyboards designed for use with IBM and IBM compatible computers to control the function of the individual "F" keys through the software utilized in the computer. The reason for this is that there are many more functions available with different programs and applications than there are "F" keys on the keyboard to perform them, with the result that is has also become common practice to assign different functions to the same key or keys, as the case may be, in different programs and applications. For example, the following chart illustrates a representative sampling of the functions of several "F" keys in a few different programs and applications:

| BASIC LANGUAGE PROGRAM | "DAC-EASY" ACCT. LITE |
|---|---|
| F-1 - List | F-1 - Help |
| F-2 - Run | F-2 - Calculator |
| F-3 - Load "____" | F-3 - Status |
| F-4 - Save "____" | F-4 - Date |
| F-5 - Continue | F-5 - (Blank) |
| F-6 - LPTI | F-6 - (Blank) |
| F-7 - Trace-On | F-7 - Print |
| F-8 - Trace-Off | F-8 - Deposit |
| F-9 - Key | F-9 - Withdrawal |
| F-10 - Screen | F-10 - (Blank) |

| "DAC-EASY" ACCT. VERS. 4.2 | PFS PROFESSIONAL WRITE |
|---|---|
| F-1 - Help | F-1 - Help |
| F-2 - Options | F-2 - File/Print |
| F-3 - (Blank) | F-3 - Edit |
| F-4 - Date | F-4 - Format |

-continued

| | |
|---|---|
| F-5 - (Blank) | F-5 - Dictionary |
| F-6 - Delete | F-6 - Addresses |
| F-7 - (Blank) | F-7 - (Blank) |
| F-8 - Add | F-8 - (Blank) |
| F-9 - Edit | F-9 - (Blank) |
| F-10 - Process | F-10 - (Blank) |

The magnitude of the problem of different "F" keys performing different functions can perhaps be imagined when one considers the astoundingly large volume of different programs and applications that are available to perform just the major non-specialized computer operations of word processing, database, spread sheet, desktop* publishing, graphic design and on-line service research. An if one considers specialized computer operations, such as CADCAM, airline reservations and ticketing, factory parts inventory, telemarketing, etc., the number of different functions becomes difficult for all but the proficient expert in the particular field to comprehend.

The major problem that confronts the computer operator is that of inadvertently hitting a wrong or inappropriate key during a particular computer operation, or series of repetitive operations, which can cause errors in data entry. The usual consequence of this is the time lost in wasted effort to locate and correct the error or errors after a problem becomes apparent, and less often, relatively consequential damage in terms of lost or misplaced data.

Frequently "F" keys are laid out in such a fashion that two adjacent "F" keys perform functions that are exactly the opposite. For example, in desktop publishing application, the "F" keys for either CUT and COPY are next to each other, and if one is performing a series of COPY and PASTE activities in the course of editing a document, and inadvertently hits the CUT key instead of the COPY key, the selected data is lost from the document at that location, and must be restored immediately or it will be lost forever. Similarly, if the activity is a series of CUT and PASTE, and the COPY key is inadvertently depressed, the selected material will remain where it is not wanted and must later be removed, at the expense of wasted time and effort.

In another example, many accounting programs have the "F" keys for deposit and withdrawal next to each other. Thus, if one is utilizing the check writing feature of the program to write a series of checks and he manually enters them into the check register, inadvertently striking the deposit key rather than the withdrawal key will result in a major error being introduced into the check register. Of course, this error, or series of errors as the case may be, will prevent the check register balance from corresponding with the closing balance on the monthly statement, thereby making it very difficult and time consuming to review the check book activity for the month to ascertain the source of the error. Further more serious damage can result from this error since the check book register will show more money in the account that what is actually on deposit, with the result that one or more checks, written after the entry error is made, may be returned for insufficient funds in the account. The consequences of this are well know.

Another example of serious consequences arising from inadvertently striking a wrong key is seen in connection with program writing where, for example, in certain languages one may find the LOAD key and the SAVE key next to each other. Thus, while working on the program and temporary variations are made to test to acceptability of these changes to the program, if the operator strikes the SAVE key rather than the LOAD, the temporary changes would be transferred form RAM to the hard disk without the operator realizing it.

The present invention seeks to overcome the foregoing problems by providing a key depression inhibitor device for preventing accidental or inadvertent manual depression of a key or combination of keys on a computer keyboard. The device comprises a relatively flat, rectangular wall member adapted to overlie the top surface of a key when the device is installed on a keyboard. A pair of opposed side wall members is attached to and depends from first opposite edges of the top wall member, and a pair of opposed end wall members is attached to and depends from second opposite edges of the top wall member, such that the top wall member and the side wall and end wall members define a generally hollow cover adapted to fit over a selected key or combination of keys on the keyboard. There are support means on the distal ends of the end wall members for supporting the device on the computer keyboard over the selected key or combination of keys, thereby preventing any key or combination of keys covered by said device form being accidentally or inadvertently depressed during normal operation of the keyboard.

In some of its more limited aspects, and end wall members depend from the top wall member further than the side wall members, and the means for supporting the device on the keyboard is on the distal ends of the end wall members. Also, the means for supporting the device comprises a flange which projects laterally outwardly form the distal ends of the end wall members, the flanges being adapted to rest on the upper surface of the keyboard adjacent to the selected key or combination of keys over which the device is placed.

In addition, the side wall members are tapered downwardly to fit between adjacent keys of the computer keyboard so as not to interfere with proper operation of any keys not covered by the key depression inhibitor.

Still further, the key depression inhibitor device is constructed in different configurations such that one depression inhibitor device can cover from one to four adjacent keys arranged in both single and double rows, thereby making the key depression inhibitor device effective to cover a single key or any selected combination of keys.

Having briefly described the general nature of the present invention, it is a principal object thereof to provide a key depression inhibitor device to temporarily cover a selected key or combination of keys to prevent accidental or inadvertent depression of those keys during normal operation of the keyboard.

Another object of the present invention is to provide a key depression inhibitor device which can be easily installed and removed from the computer keyboard, or easily switched from one key or combination of keys to another key or combination of keys.

It is a further object of the present invention to provide a key depression inhibitor device in which the principles of the invention are embodied in a variety of sizes of the device to fit over a single key or a variety of combinations of keys without having to alter any given device.

A still further object of the present invention is to provide a key depression inhibitor device which is very simple in construction, inexpensive to manufacture, rugged in use and requires no maintenance.

Other objects and advantages of the present invention will become apparent from an understanding of the following detailed description of a presently preferred embodiment of the invention when considered in conjunction with the accompanying drawings.

DETAILED DESCRIPTION OF THE INVENTION

Figure 1:
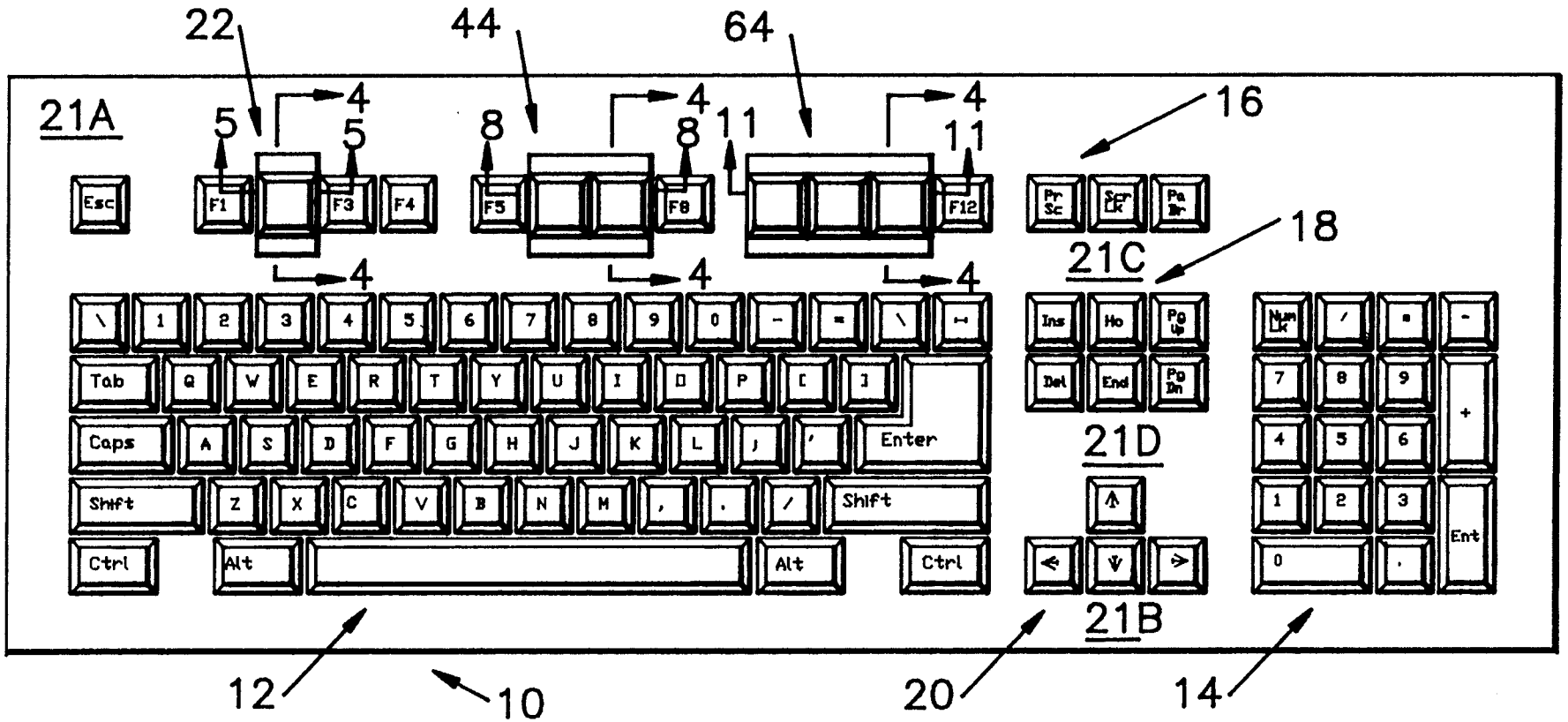
FIG. 1 is a plan view of a typical keyboard for use with a general purpose IBM or IBM compatible computer, showing three embodiments of the invention, namely single, double and triple key depression inhibitor devices installed on 1, 2 and 3 adjacent "F" keys respectively.
Figure 2:
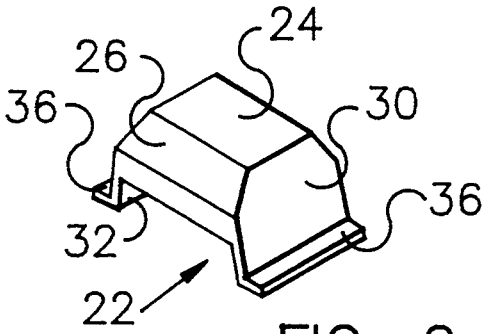
FIG. 2 is an upper side perspective view of a single key depression inhibitor.
Figure 3:
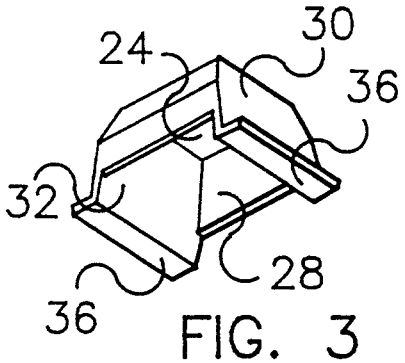
FIG. 3 is a lower side perspective view of the single key depression inhibitor.
Figure 4:
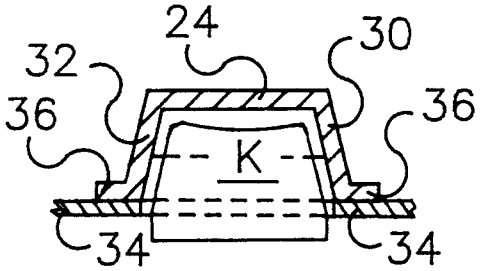
FIG. 4 is a sectional view taken on the lines 4—4 of FIG. 1 through a single, double and triple key depression inhibitor devices.

Referring now to the drawings, and particularly to FIG. 1 thereof, the reference numeral 10 designates generally a typical keyboard used with IBM and IBM compatible computers. The keyboard is generally divided into five discrete sections, an alpha section generally designated by the reference numeral 12 containing all of the alphabet keys plus the usual type control keys such as the space bar, shift, shift lock, tab, and return keys, plus the standard computer enter and control keys; a numeric section generally designated by the numeral 14 which contains number keys in a ten key pad configuration together with arithmetic keys for performing rapid number entry and manipulation functions; a variable function section generally designated by the reference numeral 16 which contains the "F" keys 1 through 15, usually in a single longitudinal row, but occasionally in two laterally adjacent longitudinal rows where additional special purpose function keys are required (not FIG. 12); a page control section generally designated by the reference numeral 18 normally containing 6 keys typically arranged in two laterally adjacent longitudinal rows and devoted to controlling the display of text on the screen; and a cursor control section generally designated by the reference numeral 20 normally containing 4 keys typically arranged in an inverted T formation with three keys in a longitudinal row and the fourth key laterally adjacent the middle key in the longitudinal row, which control the monitor cursor for vertical line to line movement or horizontal character to character movement. Throughout the following description, the letter K will designate any keyboard key or combination of keys over which any of the embodiments of the key depression inhibitor device are placed. It should be understood that other keyboard configurations are available, both for general purpose computers and for those dedicated to special purposes; however, the keyboard shown is in general use and will suffice to fully illustrate the principles of the invention.

As best seen in FIGS. 1 and 12 through 18, the keyboard has an upper frame plate indicated generally by the reference numeral 21, the frame plate 21 having appropriate openings therein through which the individual keys of the above described discrete keyboard sections 12, 14, 16, 18 and 20 protrude. Also, the discrete sections 16 and 20 are spaced laterally from the opposite longitudinal edges of the keyboard 10 to define longitudinally extending border portions 21A and 21B of the frame plate 21, and the discrete sections 16 and 18, and 18 and 20 are spaced laterally with respect to each other so as to define longitudinally extending intermediate portions 21C (which also extends between the keyboard section 16 and the alpha section 12) and 21D.

Referring now to FIGS. 2 through 5, one embodiment of the key depression inhibitor device of the present invention is therein designated generally by the reference numeral 22. The device 22 is configured to overlie a single key K (see FIGS. 4 and 5) and comprises a relatively flat top wall 24 adapted to overlie the top surface of a key when the device 22 is installed on a keyboard. A pair of opposed side walls 26 and 28, and a pair of opposed end walls 20 and 32 are attached to or formed integrally with the top wall 24 so as to depend from each side edge of the top wall 24 so that the top wall 24 and the depending side and end walls 26 through 32 define a generally hollow cover adapted to fit over a selected key or combination of keys, depending on the size of the device 22, or other embodiments of the device 22, as hereinafter fully described.

The pair of end walls 30 and 32 depend further from the top wall 24 than the pair of side walls 26 and 28. Attached to or formed integrally with the distal ends of the end walls 30 and 32 are means for supporting the device 22 on the surface of the keyboard from 21. Preferably, the supporting means comprises flanges 36 which project laterally outwardly from the end walls 30 and 32 for a relatively short distance, the lower surfaces of the flanges 36 resting on the keyboard frame 21 adjacent to the selected keys over which the device 22 is placed.

Figure 5:
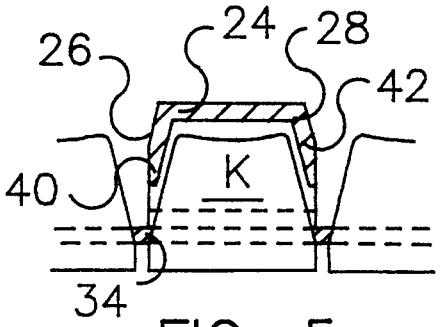
FIG. 5 is a sectional view taken on the line 5—5 in FIG. 1 through the single key depression inhibitor device.

As best seen in FIG. 5, each of the side walls 26 and 28 are set at an angle with respect to the top wall 24 which is substantially equal to the angle between the top wall and side walls of the keyboard keys K, so that the device 22 fits snugly and properly over a key and cannot be readily displaced laterally so as to overlie adjacent keys which are not intended to be covered by the key depression inhibitor device. In addition, the side walls 26 and 28 each have a tapered portion 40 and 42 respectively to facilitate the device 22 fitting closely within the space between adjacent keys K and yet not interfering with operation of an adjacent key K which is not covered by the device 22.

Figure 6:
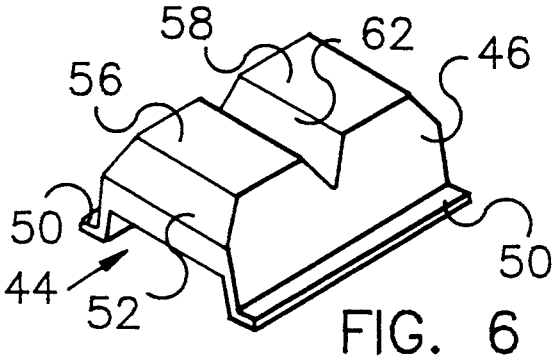
FIG. 6 is view similar to FIG. 2 of a double key depression inhibitor device.
Figure 7:
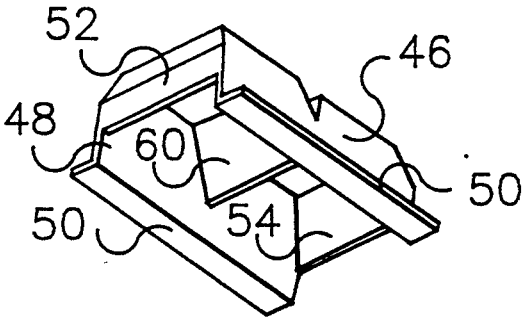
FIG. 7 is a view similar to FIG. 3 of a double key depression inhibitor device.
Figure 8:
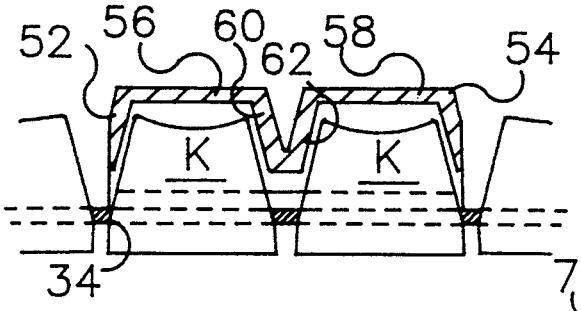
FIG. 8 is a view similar to FIG. 5 of a double key depression inhibitor device.

FIGS. 6 through 8 show another embodiment of the invention, generally designated by the reference numeral 44. This device is substantially identical to the device 22 with the exception that the end walls 46 and 48, together with the supporting flanges 50, are double the length of the corresponding walls 30 and 32, as well as the flanges 36, of the single width key device 22 shown in FIGS. 1 through 5. The side walls 52 and 54 are identical in all respects to the side walls 26 and 28 of the device 22. In addition, in the double width device 44 the top wall member is divided into two sections 56 and 58 as defined by a pair of intermediate side walls 60 and 62 which perform substantially the same function as the side walls 52 and 54, that is, to ensure that the device 44 fits properly over two adjacent keys K and cannot be readily displaced laterally to overlie the wrong keys.

Figure 9:
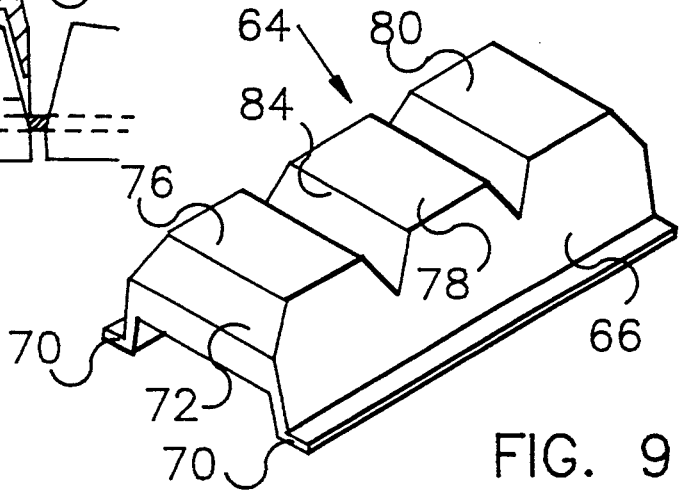
FIG. 9 is a view similar to FIGS. 2 and 6 of a triple key depression inhibitor device.
Figure 10:
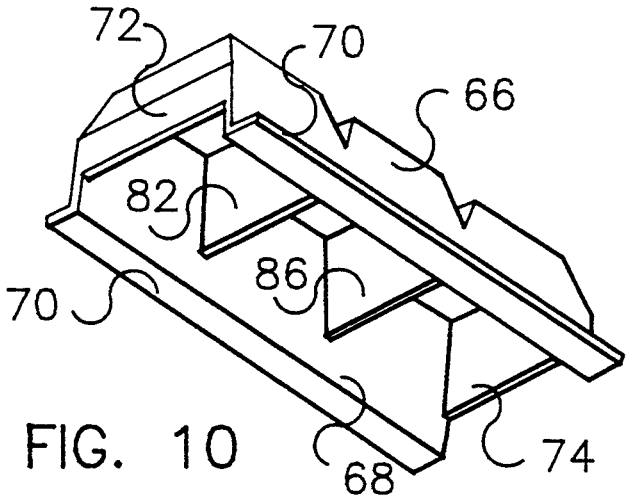
FIG. 10 is a view similar to FIGS. 3 and 7 of a triple key depression inhibitor device.
Figure 11:
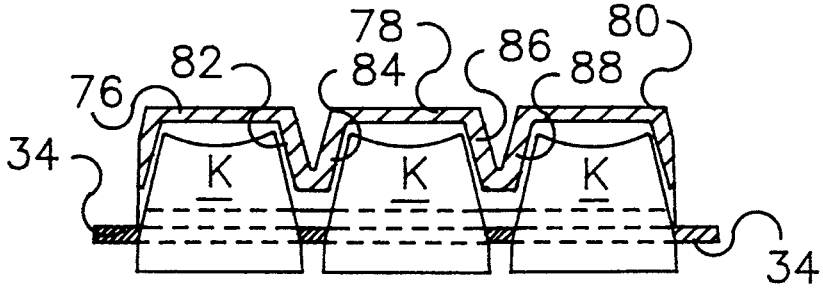
FIG. 11 is a view similar to FIGS. 5 and 8 of a triple key depression inhibitor device.

FIGS. 9 through 11 show still another embodiment of the invention generally designated by the reference numeral 64. This device is substantially identical to the device 44 with the exception that the end walls 66 and 68, together with the supporting flanges 70, are now triple the length of the corresponding walls 30 and 32, as well as the flanges 36, of the single width key device 22 shown in FIGS. 1 through 5. Again, the side walls 72 and 74 are identical in all respects to the side walls 26 and 28 of the device 22. In addition, in the triple width device 64, the top wall member is now divided into three sections 76, 78 and 80 as defined by two pairs of intermediate side walls 82 and 84, and 86 and 88, with each pair performing substantially the same function as the side walls 72 and 74 of ensuring that the device 64 fits properly over three adjacent keys K and cannot be displaced laterally.

Figure 12:
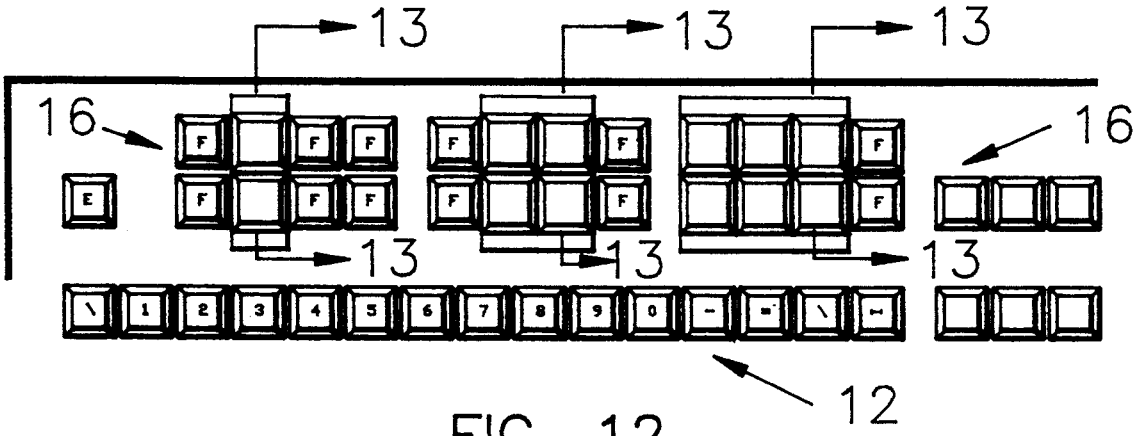
FIG. 12 is a fragmentary view similar to FIG. 1 showing three additional embodiments of the invention, namely double length single, double and triple width key depression inhibitor devices on a keyboard with a double row of "F" keys.
Figure 13:
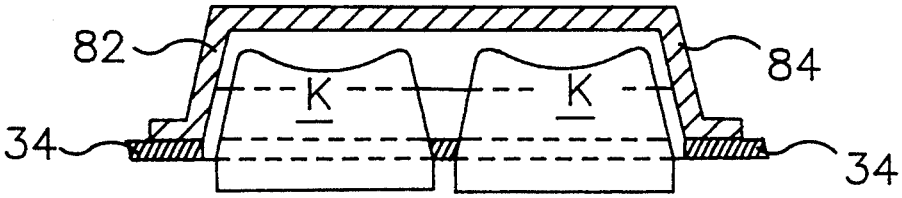
FIG. 13 is a sectional view taken on the lines 13—13 of FIG. 12 through the double length key depression inhibitor devices.

FIGS. 12 and 13 show three further embodiments of the invention generally designated by the reference numerals 76, 78 and 80. These key depression inhibitor devices are substantially identical to the devices 22, 44 and 64 shown in FIG. 1, with the exception that in each of the devices 76, 78 and 80 the side walls 82 and 84 are twice the length of the corresponding side walls of the devices 22, 24 and 26, with the result that each of the devices 76, 78 and 80 extend across two adjacent rows of keys K in the lateral direction of the keyboard. Thus, as seen in FIG. 12, the devices 76, 78 and 80 cover a single, double or triple width pair of "F" keys disposed in two laterally adjacent rows of "F" keys extending longitudinally across the keyboard.

Figure 15:
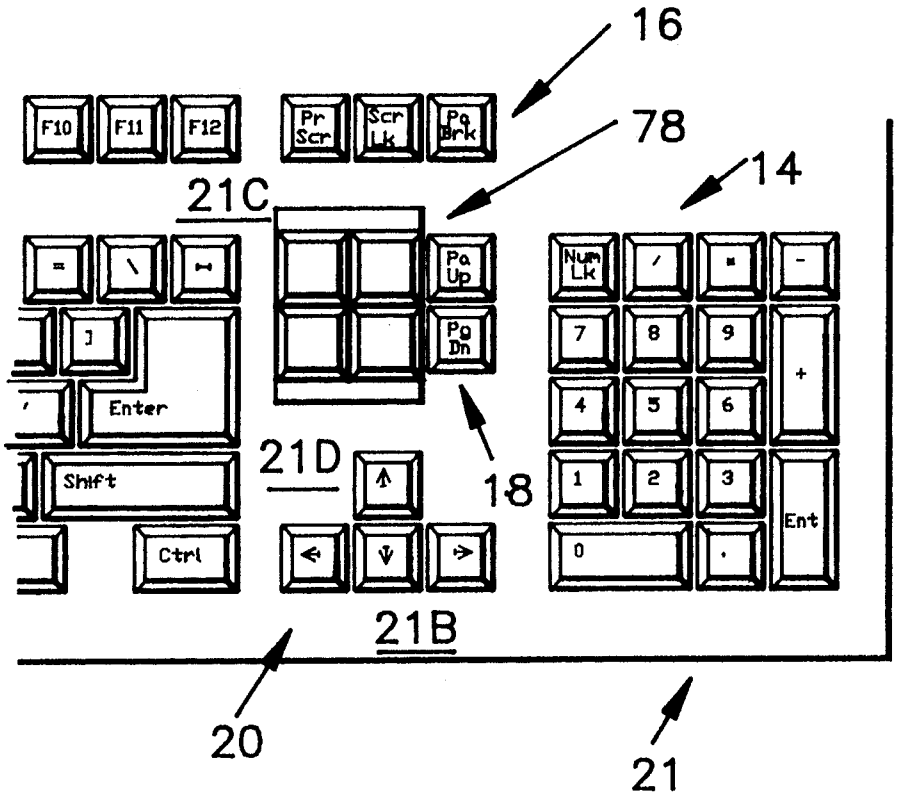
FIG. 15 is a view similar to FIG. 14 showing a double width key depression inhibitor device.
Figure 14:
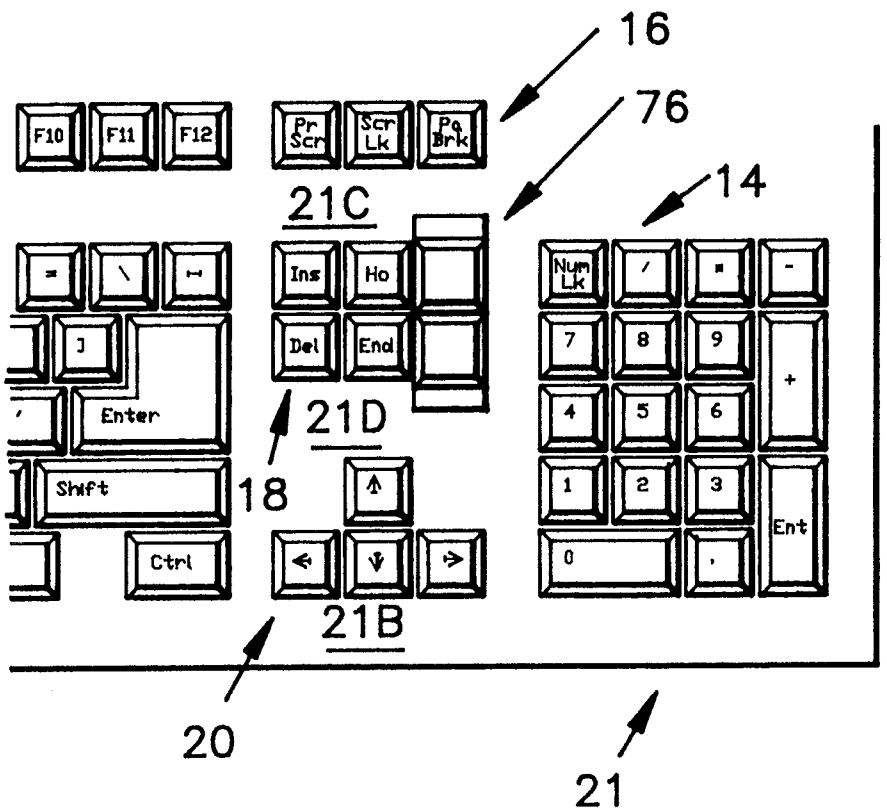
FIG. 14 is a fragmentary view showing a double length single width key depression inhibitor device installed in the page function key pad of the keyboard.
Figure 16:
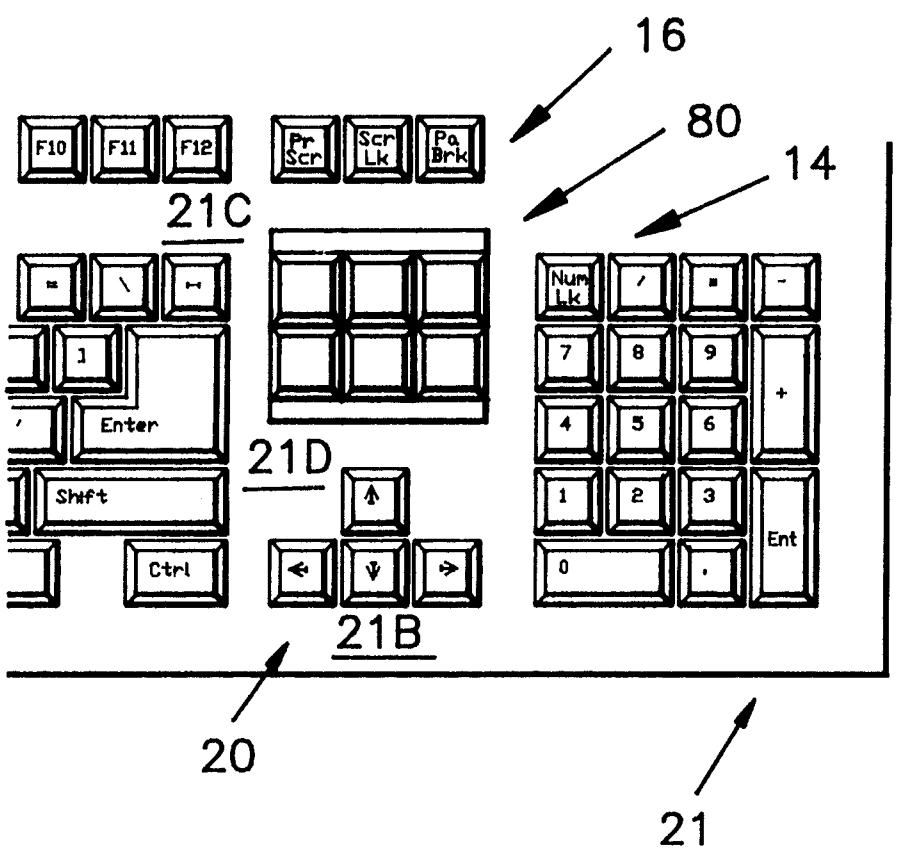
FIG. 16 is a view similar to FIGS. 14 and 15 showing a triple width key depression inhibitor device.

FIGS. 14 through 16 show alternate uses of the devices 76, 78 and 80 covering a single width, double width and triple width pairs of page control keys in the page control section 18 of the keyboard. Thus, FIG. 14 shows the "Page Up" and "Page Down" keys covered by the double length, single width device 76; FIG. 15 shows these keys plus the adjacent "Home" and "End" keys covered by the double length, double width device 78; and FIG. 16 shows all six keys in the page control section covered by the double length, triple width device 80.

Figure 17:
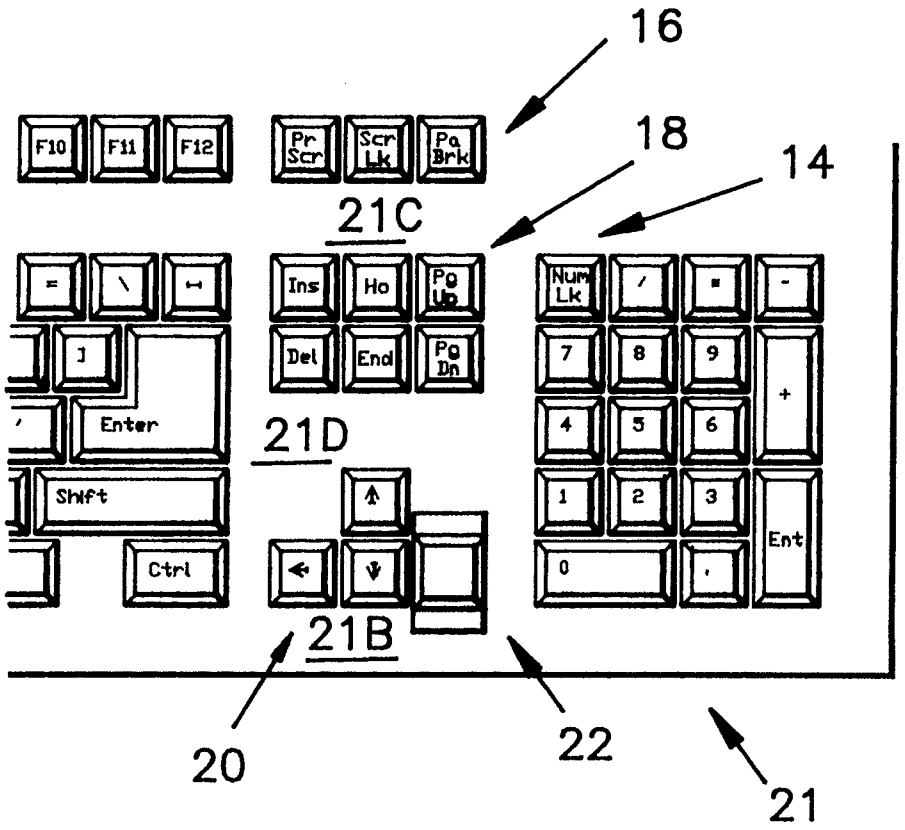
FIG. 17 is a fragmentary view showing a single length, single width key depression inhibitor device installed in the cursor function key pad of the keyboard.
Figure 19:
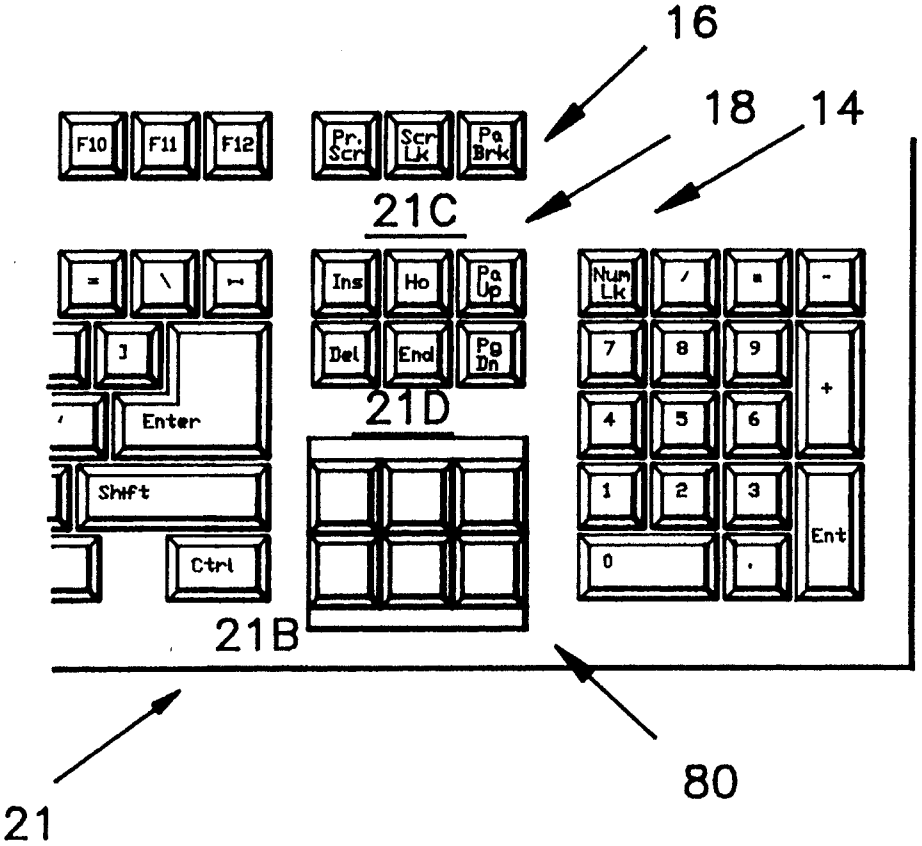
FIG. 19 is a view similar to FIGS. 17 and 18 showing a double length, triple width key depression inhibitor device.
Figure 18:
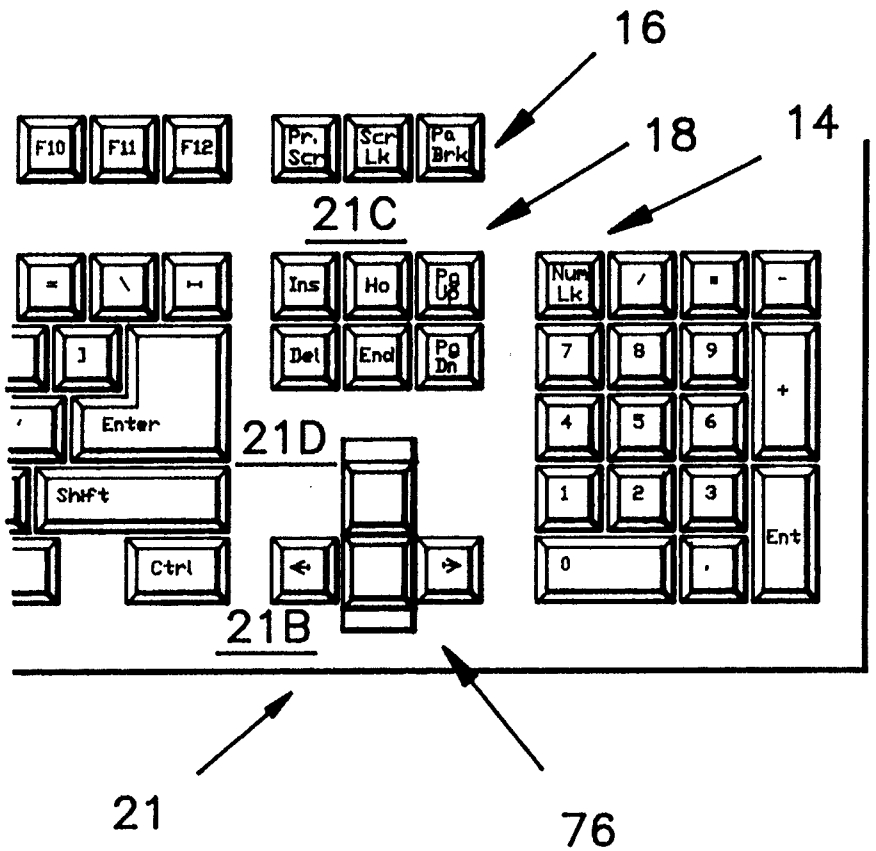
FIG. 18 is a view similar to FIG. 17 showing a double length, single width key depression inhibitor device.

FIGS. 17 through 19 show how various devices can be utilized to selectively cover one or more of the cursor control keys in the cursor control section 20 of the keyboard. Thus, a single length, single width device 22 can be used to cover either the single left or right cursor movement keys. A double length, single width device 76 can be used to cover both the up and down cursor movement keys. And a double length, triple width device 80 can be used to cover all four cursor movement keys.

It is, of course, possible to design key depression inhibitor devices in configurations other than those shown in the accompanying drawings. For example, if desired, a device could be made to cover the entire row of "F" keys, or it could be made as a single length, quadruple width device to cover each section of four "F" keys. Still further, a device could be made to cover the entire numerical key pad section 14, which could require that it be five keys in length and four keys in width.

It is believed that the manner of use of any of the key depression inhibitor devices above described is entirely apparent from the foregoing discussion and that further description thereof is not necessary for a full understanding of the invention.

It will be understood that the foregoing description and accompanying drawings describe and show presently preferred embodiments of the invention, and that variations and modifications thereof which are obvious to those skilled in the art are intended to be included within the spirit and scope of the invention as defined in the claims appended hereto.

What I claim and desire to secure by Letters Patent is:

1. A key depression inhibitor device for preventing accidental or inadvertent manual depression of a key or combination of keys on a computer keyboard, the computer keyboard having a frame plate provided with openings therein through which discrete sections of keys protrude and which define longitudinally extending border and intermediate portions of the frame laterally adjacent the discrete keyboard sections, said device comprising:

A. a relatively flat top wall adapted to overlie the top surface of a key when the device is installed on a keyboard, B. a pair of opposed side walls attached to and depending from first opposite edges of said top wall and a pair of opposed end walls attached to and depending from second opposite edges of said top wall, said top wall, side walls and end walls defining a generally hollow cover adapted to fit over a selected key or combination of keys on the keyboard, and C. means formed only on the distal end of said opposed end walls for supporting said device on the computer keyboard frame plate in the laterally adjacent longitudinally extending border and intermediate portions of the frame plate over said selected key or combination of keys, whereby any key covered by said device cannot be accidentally or inadvertently depressed during normal operation of the keyboard.

2. A key depression inhibitor device as set forth in claim 1 wherein said end walls depend from said top wall further than said side walls, said means for supporting said device being on the distal ends of said end walls.

3. A key depression inhibitor device as set forth in claim 2 wherein said means for supporting said device on the computer keyboard comprises a flange projecting laterally from said distal ends of said end walls, said flanges being adapted to rest on the upper surface of said keyboard adjacent the selected key or combination of keys over which said device is placed.

4. A key depression inhibitor device as set forth in claim 1 wherein said side walls terminate in tapered portions so that said device fits over a selected key or combination of keys without interfering with proper operation of adjacent keys.

5. A key depression inhibitor device as set forth in claims 1, 2, 3 or 4 wherein said device is generally square in horizontal cross section and is dimensionally sized to fit with close tolerance over a single computer keyboard.

6. A key depression inhibitor device as set forth in claims 1, 2, 3 or 4 wherein said device is generally rectangular and is approximately at least twice as wide between said side walls as it is long between said end walls, so that said device covers at least two longitudinally adjacent keys on said keyboard.

7. A key depression inhibitor device as set forth in claims 1, 2, 3 or 4 wherein said device is generally rectangular and is approximately twice as long between said end walls as it is wide between said side walls, so that said device covers two laterally adjacent keys on said keyboard.

8. A key depression inhibitor device as set forth in claims 1, 2, 3 or 4 wherein said device is long enough between said end walls to cover two laterally adjacent keys and is wide enough to cover at least two longitudinally adjacent keys, so that said device covers at least four longitudinally and laterally adjacent keys on said keyboard.

* * * * *